US006573229B2

(12) United States Patent
Creeth et al.

(10) Patent No.: US 6,573,229 B2
(45) **Date of Patent: *Jun. 3, 2003**

(54) LAUNDRY WASH COMPOSITIONS

(75) Inventors: Andrew Martin Creeth, Bebington (GB); Philippus Cornelis Van Der Hoeven, Vlaardingen (NL); Edwin John Staples, Bebington (GB)

(73) Assignee: Unilever Home & Personal Care USA division of Conopco Inc., Greenwich, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/210,581

(22) Filed: Aug. 1, 2002

(65) Prior Publication Data

US 2003/0017963 A1 Jan. 23, 2003

Related U.S. Application Data

(63) Continuation of application No. 09/834,015, filed on Apr. 12, 2001, now abandoned.

(30) Foreign Application Priority Data

Apr. 12, 2000 (GB) ..... 0009029

(51) Int. Cl.[7] ..... C11D 3/00; C11D 17/00

(52) U.S. Cl. ..... 510/329; 510/330; 510/336; 510/351; 510/357; 510/504; 510/499; 510/506

(58) Field of Search ..... 510/329, 330, 510/336, 351, 357, 504, 499, 506; 8/137

(56) References Cited

U.S. PATENT DOCUMENTS

| | | | | |
|---|---|---|---|---|
| 4,101,456 A | | 7/1978 | Renaud et al. | 252/551 |
| 4,510,073 A | | 4/1985 | Hara et al. | 252/383 |
| 4,764,365 A | | 8/1988 | Boothe et al. | 424/81 |
| 4,772,462 A | | 9/1988 | Boothe et al. | 424/70 |
| 4,909,986 A | * | 3/1990 | Kobayashi et al. | 422/4 |
| 5,275,809 A | | 1/1994 | Chen et al. | 424/70 |
| 5,981,456 A | | 11/1999 | Tartakovsky et al. | 510/220 |
| 6,025,314 A | | 2/2000 | Nitsch et al. | 510/221 |
| 6,103,685 A | | 8/2000 | Hall | 510/475 |
| 6,110,451 A | | 8/2000 | Matz et al. | 424/70.16 |
| 6,180,576 B1 | | 1/2001 | Melby et al. | 510/121 |
| 6,281,180 B1 | | 8/2001 | Tartakovsky et al. | 510/220 |
| 6,436,442 B1 | * | 8/2002 | Woo et al. | 424/488 |

FOREIGN PATENT DOCUMENTS

| | | | |
|---|---|---|---|
| DE | 26 16 404 | | 10/1976 |
| EP | 167 382 | | 1/1986 |
| EP | 342 997 | | 11/1989 |
| EP | 462806 | * | 12/1991 |
| EP | 462 806 | | 12/1991 |
| EP | 467 472 | | 1/1992 |
| EP | 753 571 | | 1/1997 |
| EP | 863 199 | | 9/1998 |
| GB | 2 323 385 | | 9/1998 |
| JP | 07/316 590 | | 12/1995 |
| WO | 96/17042 | | 6/1996 |
| WO | 97/09408 | | 3/1997 |
| WO | 97/42281 | | 11/1997 |
| WO | 98/53037 | | 11/1998 |
| WO | 98/58046 | | 12/1998 |
| WO | 00/44874 | | 8/2000 |

OTHER PUBLICATIONS

PCT International Search Report in a PCT application PCT/EP 01/03549, (2001).

Derwent Abstract of JP 04 153300—published May 26, 1992.

Derwent Abstract of DD 296 307—published Nov. 28, 1991.

Derwent Abstract of JP 62 018500—published Jan. 27, 1987.

J. Penfold et al., Langmuir 1995, *Solution and Adsorption Behavior of the Mixed Surfactant System Sodoium Dodecyl Sulfate/n–Hexaethylene Glyol Monododecyl Ether*,—11 2496–2503.

J. Penfold et al., Colloids and Surfaces A, *The Composition Of Mixed Surfactants and Cationic Polymer/Surfactant Mixtures Adsorbed At The Air–Water Interface*, 1997, 128, 107–117.

A. Creeth et al., J. Chem. Soc. Faraday Trans., *Composition of Mixed Surfactant–polymer Layers Absorbed At the Air/Water Interface As Determined By Specular Neutron Reflection*, 92, 4, 589–594, (1996).

L. Yingjie et al., Langmuir 1995, *Complex Formation Between Polyelectrolyte And Oppositely Charged Mixed Micelles: Soluble Complexes vs Coacervation*, 11, 2486–2492.

Co–pending Application: Creeth et al., S/N 09/834,288, Filed: Apr. 12, 2001.

Co–pending Application: Astley et al., S/N 09/837,113, Filed Apr. 18, 2001.

* cited by examiner

*Primary Examiner*—Gregory Delcotto
(74) *Attorney, Agent, or Firm*—Rimma Mitelman

(57) ABSTRACT

The present invention relates to compositions for the washing of laundry fabrics, the compositions containing anionic surfactants and a cationic detergency enhancing polymer which may be homopolymer or copolymer.

15 Claims, No Drawings

LAUNDRY WASH COMPOSITIONS

This application is a continuation of U.S. application Ser. No. 09/834,015, filed Apr. 12, 2001, now abandoned.

FIELD OF THE INVENTION

The present invention relates to compositions for the washing of laundry fabrics, the compositions containing anionic surfactants.

BACKGROUND OF THE INVENTION

Compositions for the washing of laundry items traditionally contain one or more surfactants as well as other components. The most common class of surfactant in such compositions comprises the anionic surfactants, especially synthetic non-soap anionics Often, one or more such anionic surfactants are used together in a blend with one or more nonionic surfactants. Further, although anionic and cationic surfactants are often incompatible, due to the their tendency to form a complex, recently, there have been several proposals to utilise certain compatible anionic and cationic surfactant combinations in laundry wash products.

Nevertheless, there is still a need to find surfactant systems based on anionic surfactant which give better removal of oily/greasy soil from cotton fabrics. The present invention solves this problem by incorporation of certain cationic polymers (as defined herein below). One preferred such polymer is a dimethyldiallyl ammonium chloride polymer (poly-DMDAAC). Previously, cationic polymers in general have been used in a wide range of household cleaning and personal wash applications.

For example, cationic polymers have been widely used in dishwasher rinse aid products. For example, it is known from EP-A-0 167 382, EP-A-0 342 997 and DE-A-26 16 404 to mix cationic polymers with surfactant in such product, in order to obtain clean surfaces as free from streaks as possible.

EP-A-0 167 382 describes liquid detergent compositions which can contain cationic polymers as thickeners. Hydroxypropyltrimethyl ammonium guar, copolymers of aminoethylmethacrylate and acrylamide, and copolymers of DMDAAC and acrylamide are described as particularly suitable cationic polymers.

DE-A-26 16 404 describes cleaning preparations for glass and, containing cationic cellulose derivatives. These materials are said to give better drainage of water, to produce clean, streak-free glass.

WO-A-97/09408 discloses use of cationic polymers selected from cationic polymers of copolymers of monomers such as trialkyl ammonium alkyl(meth)acrylate or -acrylamide, DMDAAC and with other counter-ions; polymer-like reaction products of ethers or esters of polysaccharides with ammonium side groups, in particular guar, cellulose and starch derivatives; polyadducts of ethylene oxide with ammonium groups; quaternary ethylene imine polymers and polyesters and polyamides with quaternary side groups as soil-release compounds in dishwasher rinse aids.

Cationic polymers are also usable in hard surface cleaners. For example, EP-A-0 467 472 describes e.g. cleaning preparations for hard surfaces, containing cationic homopolymers and/or copolymers as soil-release polymers. These polymers comprise quaternised ammonium alkylmethacrylate groups as monomer units. These compounds are used in order to render the surfaces such that the soil can be removed more easily during the next cleaning process.

EP-A-0 342 997 describes all-purpose cleaners which can contain cationic polymers, wherein in particular polymers with imino groups are used.

Another known use of such polymers is in hair shampoos. WO 97/42281 discloses compositions containing sugar-based nonionic surfactants and copolymers of acrylamide and DMDAAC to improve the tactile properties of such surfactants. Use in dishwashing applications is also mentioned.

In laundry washing/rinsing applications, several uses for cationic polymers have been proposed. Thus, JP-A-04 153300 discloses use of poly-DMDAAC in compositions containing cationic/amphoteric surfactants to enhance softness in the washing of delicate items.

Use of poly-DMDAAC as a greying-inhibitor in laundry products in disclosed in DD-A-296 307. The surfactant in these compositions is all nonionic.

JP-A-62 018500 discloses laundry detergent creams based on soap blends and cationic polymers such as poly-DMDAAC.

There is also a very large number of prior disclosures of cationic polymers used as dye fixers in laundry cleaning products, i.e. as materials for reducing the amount of dye released from fabrics, have been described in a number of references. For example, EP-A-0 462 806 describes use of such materials in rinse phase products to give protection against dye transfer during subsequent washes. Although non-soap anionic surfactant is speculatively mentioned as one optional ingredient in the product, all of the preferred product forms and specific examples thereof, either contain no surfactant or else cationic surfactant.

JP-A-07 316590 discloses detergent compositions containing cationic polymers, including poly-DMDAAC for anti-dye transfer and/or anti-soil redeposition aids. These compositions are typically bends of anionic and nonionic surfactants. In one example, detergent composition contains 25% by weight of anionic surfactant, and 25% of zeolite builder. Although sodium carbonate is also included, sodium carbonate in the absence of calcite as a crystal seed material does not contribute to calcium binding and therefore, cannot be regarded as a builder, but rather, as a pH buffer. The composition as disclosed does not contain calcite. Of the anionic surfactant, 10% by weight (based on the weight of the total composition) is linear alkylbenzene sulphonate which is a V-branched surfactant having linear alkyl limbs. In the wash liquor 10% by weight of the detergent composition of a polymer of DMDMC is added on top. The mole ratio of anionic surfactant to total cationic units in the polymer can be calculated to be substantially 0.88:1. Moreover, there is no disclosure of using such a polymer to assist removal of oily/greasy stains.

GB-A-2 323 385 discloses detergent compositions with a cationic dye-fixing ingredient. A small number of examples contains poly-DMDAAC with a molecular weight in the range 2,000 to 20,000, as a cationic dye fixing agent.

The structure and composition of an aqueous solution of a pure laboratory grade (non-branched) primary alkyl sulphate anionic surfactant namely sodium dodecyl sulphate, in the presence of poly-DMDAAC, at the air-water interface, has been described in a number of references, namely J. Penfold et al, Langmuir 1995, 11, 2496–2503, J. Penfold et al, Colloids and Surfaces A, 1997, 128, 107–117, A. Creeth et al, J. Chem. Soc., Faraday Trans., 92, 4, 589–594, and L. Yingjie et al, Langmuir 1995, 11, 2486–2492. A wide range of model compositions to explore these phenomena are disclosed in these references.

The present inventors have now found that certain polymers containing DMDAAC and its analogues can be combined with a branched anionic surfactant to enhance oily/greasy soil removal from cotton fabrics. However, none of the aforementioned reference discloses this novel use, nor a mole ratio of branched anionic surfactant to total cationic monomer units in the polymer of greater than 1:1.

DEFINITION OF THE INVENTION

Thus, a first aspect of the invention now provides a laundry washing composition comprising:

(a) anionic surfactant comprising at least one surfactant compound of formula (I):

$$R^1—Z^-M^+ \quad (I)$$

wherein $R^1$ is a branched hydrophobic group;

$Z^-$ is a hydrophilic anion; and $M^+$ is a counter cation, preferably an alkali metal ion such as sodium;

(b) a detergency enhancing polymer which is a homopolymer or copolymer containing one or more monomer units independently selected from those of formula (II)

(II)

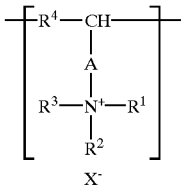

wherein

—A— is selected from groups of formula $—R^5—$, $—R^5—(CO)—R^6—$, $—R^5—(CO)—O—R^6$, $—R^5—O—(CO)—R^6—$, $—R^5—(CO)—NH—R^6—$, $—R^5—NH—(CO)—R^6—$, wherein $R^5$ and $R^6$ are independently absent, or represent $C_{1-3}$ alkyl groups;

$R^1$, $R^2$ and $R^3$ are independently selected from hydrogen, $C_{1-3}$ alkyl, $C_{1-3}$ alkenyl, hydroxy-$C_{1-3}$ alkyl and $C_{5-8}$ cycloalkyl groups; and $R^4$ is selected from groups as defined for A above;

wherein $R^3$ may also represent a bridging group to the group $R^4$, said bridging group being selected from groups as defined for A above; and $X^-$ is a monovalent anion or an n'th part of an n-valent anion; and (c) optionally, one or more other ingredients;

wherein, when the composition comprises sodium tripolyphosphate builder, the composition is particulate and has a bulk density of at least 650 g/liter and when the composition comprises zeolite builder the amount of zeolite builder is no more than 19% by weight of the composition.

A second aspect of the present invention provides a laundry washing composition comprising:

(a) anionic surfactant comprising at least one surfactant compound of formula (I):

$$R^1—Z^-M^+ \quad (I)$$

wherein $R^1$ is a branched hydrophobic group;

$Z^-$ is a hydrophobic anion; and $M^+$ is a counter cation, preferably an alkali metal ion such as sodium;

(b) a detergency enhancing polymer which is a homopolymer or copolymer containing one or more monomer units independently selected from those of formula (II)

(II)

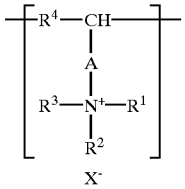

wherein

—A— is selected from groups of formula $—R^5—$, $—R^5—(CO)—R^6—$, $—R^5—(CO)—O—R^6$, $—R^5—O—(CO)—R^6—$, $—R^5—(CO)—NH—R^6—$, $—R^5—NH—(CO)—R^6—$, wherein $R^5$ and $R^6$ are independently absent, or represent $C_{1-3}$ alkyl groups;

$R^1$, $R^2$ and $R^3$ are independently selected from hydrogen, $C_{1-3}$ alkyl, $C_{1-3}$ alkenyl, hydroxy-$C_{1-3}$ alkyl and $C_{5-8}$ cycloalkyl groups; and $R^4$ is selected from groups as defined for A above;

wherein $R^3$ may also represent a bridging group to the group $R^4$, said bridging group being selected from groups as defined for A above; and $X^-$ is a monovalent anion or an n'th part of an n-valent anion; and (c) optionally, one or more other ingredients;

wherein the detergency enhancing polymer has a weight average molecular weight of from 50,000 to 150,000.

Hereinafter, the anionic surfactant component (a) based on the anionic surfactants of formula (I) will be referred to as the "branched anionic surfactant".

DETAILED DESCRIPTION OF THE INVENTION

Compositions according to the present invention contain the branched anionic surfactant, the polymer in the amount specified and optionally one or more other ingredients. As demonstrated in the examples, the polymer has been found to enhance the detergency of the anionic cotton in removal of oil/greasy stains from cotton fabrics.

More specifically, it has now been found that fatty/oily soil removal is especially effective if not only does the anionic surfactant contain at least some branched anionic surfactant but also if the amount of anionic surfactant relative to cationic monomer units in the polymer is higher than in the compositions where such polymers have been used for dye fixation or other purposes. Without being bound by any particular theory or explanation, it is believed that this is because the branched anionic surfactant mitigates against the formation of liquid crystalline phases at the soil/wash liquor interface. Moreover only relatively small amounts of total anionic surfactant-polymer complex are needed to exert the effect, leaving the remainder of the anionic free to assist other cleaning functions in the wash liquor.

Component (c) in compositions according to the invention stipulates optionally, one or more other ingredients. In other words, these other ingredients do not have to be present. Preferably however, compositions according to the invention contain one or more other ingredients typically found in laundry wash products. Preferably, these are selected from one or more of surfactants (other than the anionic surfactant), builders, bleaches, enzymes and minor ingredients.

The Polymer

The detergency enhancing polymer can be a homopolymer or copolymer. Random, block and mixed block/random copolymers are all possible. The polymer may include one or more polymer species which include a monomer unit of formula (II).

Preferably, the monomer units of formula (II) are those where A is methylene (—$CH_2$—) or carbonyl (—CO—) and $R^4$ is methylene (—$CH_2$—) or ethylene (—$CH_2CH_2$—).

Especially preferred are polymers containing at least some monomer units of formula (I) in which A is methylene, $R^1$ and $R^2$ are methyl, and $R^3$ and $R^4$ together represent —(CH—)—$CH_2$—, i.e. DMDAAC. Preferably at least 50% of the monomer units of formula (I), more preferably at least 80%, more preferably at least 90%, most preferably substantially 100% are DMDAAC units.

For the avoidance of doubt, it should be noted that the DMDAAC unit can also exist in the polymer in the form

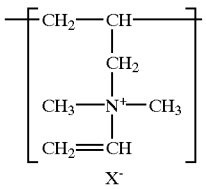

i.e. where the second allyl group remains unsaturated and does not form a ring closing bridging group constituted by groups $R^2$ and $R^4$ of formula (I). The double bond of this allyl group can also cross-link with other polymers in the sample and it can also form block co-polymers comprising the monomer unit —$CH_2$—$CH_2$—$CH_2$—$(CH_3)_2N^+$—$CH_2$—$CH_2$—$CH_2$—. Thus, polymers formed of monomer units of formula (I) in which any of $R^1$—$R^3$ is/are alkenyl groups may contain monomers with any one or more of the aforementioned structural transformations, including ring-closures, cross linking, block co-polymer formations, as well as the unpolymerised terminal unsaturated groups.

Thus, for example, where $R^2$ and $R^4$ together form a linking group $R^5$ by virtue of breakage of a double bond when $R^2$ is $C_{2-4}$ alkenyl, the resultant monomer unit may be represented thus:

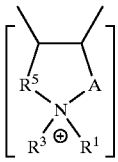

For the example of the DMDAAC monomer unit mentioned above, the corresponding cyclic structure would therefore be:

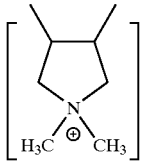

In the case of copolymers, a wide range of other monomer units may be used, for example selected from those derived from unsaturated monocarboxylic acids such as acrylic acid, methacrylic acid, crotonic acid and the like, and their esters and salts, olefins such as ethylene, propylene and butene, alkyl esters of unsaturated carboxylic acids such as methylacrylate, ethylacrylate, methylmethacrylate, their hydroxy derivatives such as 2-hydroxyethylmethacrylate, unsaturated aromatic compounds such as styrene, methyl styrene, vinyl styrene, and heterocyclic compounds such as vinylpyrrolidone. However, most preferred are —$CH_2$—$CH_2$— co-monomer units.

The monomer units of formula (I) are cationic. Optionally one or more other cationic monomer units may also be incorporated. For example, these may be chosen from any other cationic monomer unit structures disclosed in JP-A-07 316 590.

Preferably, the proportion of all cationic monomer units is from 40 mol % to 95 mol %, in order for the polymers to have adequate water-solubility.

It is preferred that the weight average molecular weight of the polymer is from 320 to 10,000,000, more preferably from 5,000 to 500,000, most preferably from 50,000 to 150,000. This weight average molecular weight is typically determined by the method of laser light scattering in combination with gel permeation chromatography (GPC).

In formula (II), counter anions $X^-$ may be the same of different and may include mixtures of such anions. They may for example be halide ions such as chloride or bromide, $SO_4^{2-}$ or $CH_3SO_4^-$.

Generally speaking, the amount of polymers in the composition will usually be from 0.05% to 10% by weight, although from 0.1% to 5% will be typical.

Synthesis of the Polymer

Many polymers based on DMDAAC and analogous monomer units are commercially available. However, formula (I) also embraces monomer units, polymers of which cannot be obtained commercially. The detergency enhancing polymers utilised in the present invention may be obtained from polymerisation of respective monomers corresponding to the monomer unit of formula (I), optionally other cationic monomer units and optionally, any other, e.g. neutral (uncharged), monomer units, each respectively being ethylenically unsaturated. The different available means of copolymerising such ethylenically unsaturated monomers will be well known to those skilled in the art of polymer chemistry. Depending on the order of addition of reactants, the resulting polymers may be block, random or mixed block/random copolymers.

Surfactants

Compositions according to the invention comprises one or more surfactants at least one of which is a branched anionic surfactant suitable for use in laundry wash products.

Where other surfactants are included in a blend with the anionic surfactant(s), these may be chosen from one or more of cationic, nonionic amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The total level of all surfactant(s) in the composition as a whole may for example be from 0.1% to 70% by weight the total composition but is preferably from 5% to 40%.

Anionic Surfactants

At least one of the surfactants must be a branched anionic surfactant. The mole ratio of all anionic surfactant to the total of cationic monomer units in the detergency enhancing polymer is preferably at least 1:1, more preferably at least 2.5:1, still more preferably from 25:1 to 2.5:1, yet more preferably from 20:1 to 3:1, especially from 10:1 to 5:1.

The branched anionic surfactant is an essential component of compositions according to the present intention. However, in general, the anionic surfactant in compositions according to the present invention may comprise one or more soap and non-soap anionic surfactant materials e.g. selected from one or more of the types disclosed in the aforementioned reference of Schwartz, Perry and Berch.

Preferably, $R^1$ is a branched group selected from branched alkyl, alkylaryl (e.g. alkylbenzene or alkylnaphthyl) and alkenyl groups most preferably having from 6 to 24 carbon atoms in the aliphatic part thereof.

Preferably also, $Z^-$ represents a sulphate, sulphonate, carboxylate or phosphonate group, any at which is optionally linked to $R^1$ via a linking moiety, such as a (poly) $C_{2-4}$ alkyleneoxy moiety, forming part of $Z^-$. In the latter example (when present) preferably there may for example be from 1 to 7 alkyleneoxy groups (which may be the same or different) and which are preferably selected from alkyleneoxy and/or propyleneoxy groups.

As all or part (e.g at least 50%, 60%, 70%, 80%, 90% or 95% by weight) of the branched anionic surfactant component, most preferred are the linear alkylbenzene sulphonate anionic surfactants having an average alkyl component of $C_8$–$C_{15}$, especially those having a V-shaped hydrophobe group $R^1$, i.e. branching at the point of attachment to the benzene sulphonate group but each arm of the V is linear. Commercial products contain a mixture of different chain lengths for each arm length. Paradoxically, such V-branched materials are sometimes referred to as "linear" alkylbenzene sulphonates.

Typically, the branched anionic surfactant represents from 30% to 100% by weight of the total anionic surfactant preferably from 40% to 70%. It is also preferred if the level of branched anionic surfactant is from 0.5 wt % to 30 wt %, more preferably 1 wt % to 25 wt %, most preferably from 2 wt % to 20 wt % of the total composition.

Another preferred class of branched anionic surfactant comprises those disclosed in WO-A-99/19428 in which $R^1$ is attached to the $Z^-$ moiety via a group —$R^x$— (wherein $R^x$ is absent or is a linking group such as phenylene), $R^1$ being a hydrophobic mid-chain branched alkyl moiety, having in total 9 to 22 carbons in the moiety, preferably from 12 to about 18, having: (1) a longest linear carbon chain attached to the —$R^x$—$Z^-$ moiety in the range of from 8 to 21 carbon atoms; (2) one or more $C_1$–$C_3$ alkyl moieties branching from this longest linear carbon chain; (3) at least one of the branching alkyl moieties is attached directly to a carbon of the longest linear carbon chain at a position within the range of the position 2 carbon, counting from position 1 carbon (#1) which is attached to the —$R^x$—$Z^-$ moiety, to the position of the terminal carbon minus 2 carbons, (the (ω-2) carbon); and (4) when more than one of these compounds is present, the average total number of carbon atoms in the $R^1$—$R^x$— moieties in the above formula is within the range of greaterthan 14.5 to about 18, preferably from about 15 to about 17. Preferred $R^1$ groups as defined in WO-A-99/19428 are branched primary alkyl moieties having the formula:

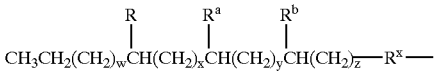

wherein the total number of carbon atoms in the branched primary alkyl moiety of this formula (including the R, $R^a$, and $R^b$ branching) is from 13 to 19; R, $R^x$ is as hereinbefore defined $R^a$, and $R^b$ are each independently selected from hydrogen and $C_1$–$C_3$ alkyl (preferably methyl), provided R, $R^a$, and $R^b$ are not all hydrogen and, when z is 0, at least R or $R^a$ is not hydrogen; w is an integer from 0 to 13; x is an integer from 0 to 13; y is an integer from 0 to 13; z is an integer from 0 to 13; and w+x+y+z is from 7 to 13.

Yet other suitable branched anionic surfactants include secondary alkylsulphonates, secondary alcohol sulphates and secondary alkyl carboxylates.

The laundry wash compositions of the invention may additionally or alternatively contain one or more other anionic surfactants in total amounts corresponding to percentages quoted above for branched anionic surfactants, provided that at least some branched anionic surfactant is present. Suitable anionic surfactants are well-known to those skilled in the art. These include primary alkyl sulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred. Such other anionic surfactants typically are used at from 5% to 70% by weight of the total anionic surfactant, preferably from 10% to 30%. Moreover, they typically represent from 1% to 15% by weight of the total composition.

Nonionic Surfactants

The compositions of the invention preferably also contain nonionic surfactant. Nonionic surfactants that may be used include fatty acid methyl ester ethoxylates (FAMEE's), e.g. as supplied by Lion Corp., Henkel KGA, Condea or Clairant, the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

It is preferred if the level of total non-ionic surfactant is from 0 wt % to 30 wt %, preferably from 1 wt % to 25 wt %, most preferably from 2 wt % to 15 wt % by weight of the total composition.

Other Surfactants

Another class of suitable surfactants comprises certain mono-long chain-alkyl cationic surfactants for use in main-wash laundry compositions according to the invention. Cationic surfactants of this type include quaternary ammonium salts of the general formula $R_1R_2R_3R_4N^+ X^-$ wherein the R groups are long or short hydrocarbon chains, typically alkyl, hydroxyalkyl or ethoxylated alkyl groups, and X is a counter-ion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

The choice of surface-active compound (surfactant), and the amount present in the laundry wash compositions according to the invention, will depend on the intended use of the detergent composition. In fabric washing compositions, different surfactant systems may be chosen, as is well known to the skilled formulator, for handwashing products and for products intended for use in different types of washing machine. The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2–60%, preferably 15–40% most preferably 25–35%.

Surfactant Blends

Preferred blends comprise the anionic surfactant(s) and one or more nononic surfactants. Compositions suitable for use in most automatic fabric washing machines will generally contain anionic non-soap surfactant, or non-ionic surfactant, or combinations of the two in any suitable ratio, optionally together with soap. Typical blends contain total anionic to total nonionic surfactant in a weight ratio of from 5:1 to 1:1, preferably from 4:1 to 2:1.

It is also generally preferred that the weight ratio of total anionic surfactant to total builder is from 1:5 to 10:1, more preferably from 2:1 to 10:1, especially from 3:1 to 7:1. Regardless of these ratios, it is also preferred if the weight ratio of total branched anionic surfactants to total builder is from 1:5 to 10:1, more preferably from 1:1 to 7:1.

Detergency Builders

The compositions of the invention, when used as laundry wash compositions, will generally also contain one or more detergency builders. The total amount of detergency builder in the compositions will typically range from 5 to 80 wt %, preferably from 10 to 60 wt % by weight of the total composition.

Inorganic builders that may be present include sodium carbonate, if desired in combination with a crystallisation seed for calcium carbonate, as disclosed in GB-A-1 437 950; crystalline and amorphous aluminosilicates, for example, zeolites as disclosed in GB-A-1 473 201, amorphous aluminosilicates as disclosed in GB-A-1 473 202 and mixed crystalline/amorphous aluminosilicates as disclosed in GB-A-1 470 250; and layered silicates as disclosed in EP-A-164 514. Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

When the aluminosilicate is zeolite, the maximum amount is 19% by weight.

The alkali metal aluminosilicate may be either crystalline or amorphous or mixtures thereof, having the general formula: 0.8–1.5 $Na_2O$. $Al_2O_3$. 0.8–6 $SiO_2$.

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP-A-384 070. Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Bleaches

Laundry wash compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persaits are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB-A-2 123 044.

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium noanoyloxybenzene sulphonate (SNOBS). The novel quaternary ammonium and phosphonium bleach precursors disclosed in U.S. Pat. Nos. 4,751,015 and 4,818,426 and EP-A-402 971, and the cationic bleach precursors disclosed in EP-A-284 292 and EP-A-303 520 are also of interest.

The bleach system can be either supplemented with or replaced by a peroxyacid. examples of such peracids can be found in U.S. Pat. Nos. 4,686,063 and 5,397,501. A preferred example is the imido peroxycarboxylic class of peracids described in EP-A-325 288, EP-A-349 940, DE-A-382 3172 and EP-A-325 289. A particularly preferred example is phtalimido peroxy caproic acid (PAP). Such peracids are suitably present at 0.1–12%, preferably 0.5–10%.

A bleach stabiliser (transition metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP-A-458 397, EP-A-458 398 and EP-A-509 787.

Enzymes

Laundry wash compositions according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins which are obtained from particular strains of *B. Subtilis B. licheniformis,* such as the commercially available subtilisins Maxatase (Trade Mark), as supplied by Gist Brocades N. V., Delft, Holland, and Alcalase (Trade Mark), as supplied by Novo Industri A/S, Copenhagen, Denmark.

Particularly suitable is a protease obtained from a strain of Bacillus having maximum activity throughout the pH range of 8–12, being commercially available, e.g. from Novo Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

Other Optional Minor Ingredients

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Yet other materials that may be present in detergent compositions of the invention include sodium silicate; antiredeposition agents such as cellulosic polymers; inorganic salts such as sodium sulphate; lather control agents or lather boosters as appropriate; dyes; coloured speckles; perfumes; foam controllers; fluorescers and decoupling polymers. This list is not intended to be exhaustive.

Product Form

Compositions according to the first aspect of the present invention may be formulated in any convenient form, for example as powders, liquids (aqueous or non-aqueous) or tablets.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/1, more preferably at least 500 g/1. Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP-A-340 013, EP-A-367 339, EP-A-390 251 and EP-A-420 317.

Liquid detergent compositions according to the invention can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

Tablet compositions according to the invention may for example be prepared by mixing a base powder comprising the anionic surfactant, the polymer of formula (I) and other optional ingredients and tabletting the base powder in a Carver hand press to form cylindrical tablets of approximately 44 mm diameter, as described in WO-A-98/42817 and WO-A-99/20730.

The present invention will now be explained in more detail by way of the following non-limiting examples.

EXAMPLES

| Example | A | 1 | 2 | B | 3 | 4 | C | 5 | 6 |
|---|---|---|---|---|---|---|---|---|---|
| NaLAS[1] | 13 | 12.35 | 11.7 | 13 | 12.35 | 11.7 | 6 | 5.7 | 5.4 |
| Nonionic[2] | — | — | — | 13 | 13 | 13 | 7 | 7 | 7 |
| STP[3] | 23 | 23 | 23 | 23 | 23 | 23 | — | — | — |
| Zeolite[4] | — | — | — | — | — | — | 22 | 22 | 22 |
| $Na_2CO_3$ | 10 | 10 | 10 | 10 | 10 | 10 | — | — | — |
| Na disilicate | 6 | 6 | 6 | 6 | 6 | 6 | — | — | — |
| Polymer[5] | — | 0.65 | 1.3 | — | 0.65 | 1.3 | — | 0.3 | 0.6 |
| NaLAS: Polymer | — | 19:1 | 9:1 | — | 19:1 | 9:1 | — | 19:1 | 9:1 |

[1]$C_{11-12}$ alkylbenzene sulphonate, sodium salt
[2]Nonionic surfactant having an average of from 3 to 7 ethylene oxide units per mole, and an alkyl chain length of from 9 to 15 carbon atoms.
[3]Sodium tripolyphosphate
[4]Zeolite 24, aluminosilicate builder
[5]Poly-DMDAAC, wt. av. MW = 100,000 as determined by GPC.

In the following evaluation results, the compositions were in all cases dosed at 5.0 g/l. The wash regime was 30 minutes washing in 17° FH water hardness.

In a laboratory scale wash evaluation (LWE) simulating a machine wash, examples A and 1 were tested for washing performance with cotton soiled with kitchen grease and examples A, and 2 were tested in a minibottle (MBT) test for each performance with cotton collars and cuffs stained with sebum.

| | Reflectance Units (RU) | |
|---|---|---|
| Example | LWE | MBT |
| A | 15.2 | 14.1 |
| 1 | 15.4 | — |
| 2 | — | 15.1 |

Examples B, 3 and 4 were compared in an LWE test for performance in removing olive oil and carbon back staining on cotton.

| Example | RU |
|---|---|
| B | 2.6 |
| 3 | 2.7 |
| 4 | 2.9 |

Examples C, 5 and 6 were compared in a MBT test for performance against sebum soiling of cotton collars and cuffs.

| Example | RU |
|---|---|
| C | 14.0 |
| 5 | 15.4 |
| 6 | 14.9 |

What is claimed is:

1. A process for removal of oily and greasy soil from laundry fabrics which comprises washing the soiled fabrics with a laundry washing composition comprising:

(a) anionic surfactant comprising at least one surfactant compound of formula (I):

$$R^1—Z^-—M^+ \quad (I)$$

wherein $R^1$ is a branched hydrophobic group;

$Z^-$ is a hydrophobic anion; and $M^+$ is a counter cation, (b) a detergency enhancing polymer which is a homopolymer or copolymer containing one or more monomer units independently selected from those of formula (II)

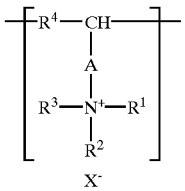

(II)

wherein

—A— is selected from groups of formula —$R^5$—, —$R^5$—(CO)—$R^6$—, —$R^5$—(CO)—O—$R^6$, —$R^5$—O—(CO)—$R^6$—, —$R^5$—(CO)—NH—$R^6$—, —$R^5$—NH—(CO)—$R^6$—, wherein $R^5$ and $R^6$ are independently absent, or represent $C_{1-3}$ alkyl groups;

$R^1$, $R^2$ and $R^3$ are independently selected from hydrogen, $C_{1-3}$ alkyl, $C_{1-3}$ alkenyl, hydroxy-$C_{1-3}$ alkyl and $C_{5-8}$ cycloalkyl groups; and $R^4$ is selected from groups as defined for A above;

wherein $R^3$ may also represent a bridging group to the group $R^4$, said bridging group being selected from groups as defined for A above; and $X^-$ is a monovalent anion or an n'th part of an n-valent anion; and (c) optionally, one or more other ingredients;

wherein, when the composition comprises sodium tripolyphosphate builder, the composition is particulate and has a bulk density of at least 650 g/liter and when the composition comprises zeolite builder, the amount of zeolite builder is no more than 19% by weight of the composition;

wherein the weight average molecular weight of the polymer (b) is from 50,000 to 150,000.

2. The process of claim 1, wherein the composition does not comprise zeolite builder and the mole ratio of anionic surfactant to the total of all cationic monomer units in the detergency enhancing polymer is at least 1:1.

3. The process of claim 1, wherein in at least some of unit(s) of formula (II) in the polymer (b), A is methylene or carbonyl and $R^4$ is methylene or ethylene.

4. The process of claim 1, wherein in at least some of the monomer units of formula (II) in the polymer (b), A is methylene, $R^1$ and $R^2$ are both methyl, and $R^3$ and $R^4$ together represent —(CH—)—$CH_2$—, or structural variants thereof.

5. The process of claim 1, claim, wherein in the polymer (b), the monomer units of formula (I) comprise at least 50% of the monomer units as defined in claim 3.

6. The process of claim 1, wherein the polymer (b) contains at least 40 mole % of cationic monomer units.

7. The process of claim 1, wherein in formula (I) of the surfactant (a), $R^1$ is a branched group selected from branched alkyl, alkylaryl and alkenyl groups.

8. The process of claim 1, wherein in formula (I) for the surfactant (a), $Z^-$ is selected from sulphate, sulphonate, carboxylate and phosphonate groups optionally linked to $R^1$ via a (poly) $C_{2-4}$ alkyleneoxy moiety.

9. The process of claim 1, wherein in the laundry detergent composition the anionic surfactant comprises from 0.5% to 30% 25%, more by weight of the total composition of branched anionic surfactant.

10. The process of claim 1, wherein in the laundry detergent composition the anionic surfactant comprises from 30% to 100% of branched anionic surfactant based on the weight of total anionic surfactant.

11. The process of claim 1, wherein the laundry detergent composition comprises from 1% to 25%by weight of the total composition, of nonionic surfactant.

12. The process of claim 11, wherein in the laundry detergent composition the weight ratio of total anionic surfactant to total nonionic surfactant is from 5:1 to 1:1.

13. The process of claim 1, wherein the laundry detergent composition comprises from 5% to 80% by weight of the total composition of detergency builder.

14. The process of claim 2, wherein in the laundry detergent composition the mole ratio of anionic surfactant to the total of all cationic monomer units in the detergency enhancing polymer is from 25:1 to 2.5:1.

15. The process of claim 5, wherein the monomer units of formula (II) in the polymer (b) comprise at least 90% of the monomer units as defined in claim 3.

* * * * *